US010378285B2

(12) United States Patent
Livingstone

(10) Patent No.: US 10,378,285 B2
(45) Date of Patent: Aug. 13, 2019

(54) DOWNHOLE MOTOR

(71) Applicant: Dynomax Drilling Tools Inc., Leduc (CA)

(72) Inventor: Dean Livingstone, Leduc (CA)

(73) Assignee: Dynomax Drilling Tools Inc., Leduc (CA)

( * ) Notice: Subject to any disclaimer, the term of this patent is extended or adjusted under 35 U.S.C. 154(b) by 0 days.

(21) Appl. No.: 14/773,685

(22) PCT Filed: Mar. 7, 2014

(86) PCT No.: PCT/CA2014/050192
§ 371 (c)(1),
(2) Date: Sep. 8, 2015

(87) PCT Pub. No.: WO2014/134736
PCT Pub. Date: Sep. 12, 2014

(65) Prior Publication Data

US 2016/0047169 A1 Feb. 18, 2016

Related U.S. Application Data

(60) Provisional application No. 61/774,405, filed on Mar. 7, 2013.

(51) Int. Cl.
*E21B 4/02* (2006.01)
*E21B 10/28* (2006.01)
*E21B 10/30* (2006.01)

(52) U.S. Cl.
CPC ..... *E21B 10/28* (2013.01); *E21B 4/02* (2013.01); *E21B 10/30* (2013.01)

(58) Field of Classification Search
CPC ..... E21B 4/02; E21B 10/26–30
USPC ..... 175/107
See application file for complete search history.

(56) References Cited

U.S. PATENT DOCUMENTS

| | | | |
|---|---|---|---|
| 1,176,965 | A | 3/1916 | Hughes |
| 1,204,157 | A | 11/1916 | Hughes |
| 1,399,831 | A | 12/1921 | Wadsworth |
| 1,747,908 | A | 2/1930 | Seifert |

(Continued)

FOREIGN PATENT DOCUMENTS

| | | | |
|---|---|---|---|
| CA | 1 212 098 | A | 9/1986 |
| EP | 0 333 450 | A1 | 9/1989 |

(Continued)

OTHER PUBLICATIONS

Schlumberger, "PowerDrive vorteX RT," Product Information Sheet, #09-DR-0112, 2009, 2 pages.

(Continued)

*Primary Examiner* — Giovanna C Wright
(74) *Attorney, Agent, or Firm* — Seed Intellectual Property Law Group LLP

(57) ABSTRACT

A downhole mud motor is formed of plural housings containing at least a drive section and a transmission section. At least a housing of the plural housings has a longitudinal axis and incorporates a reaming section with one or more rotary reamers. Each of the one or more rotary reamers is mounted in a respective pocket for rotation about a transverse axis relative to the longitudinal axis of the housing.

8 Claims, 5 Drawing Sheets

(56) References Cited

U.S. PATENT DOCUMENTS

| | | | | |
|---|---|---|---|---|
| 1,809,258 | A * | 6/1931 | Vertson | E21B 10/16 15/104.02 |
| 1,899,727 | A | 2/1933 | Sandstone | |
| 2,399,372 | A | 4/1946 | Metzger et al. | |
| 2,637,529 | A | 5/1953 | Howell | |
| 3,173,500 | A | 3/1965 | Stuart et al. | |
| 3,398,804 | A | 8/1968 | Holbert | |
| 4,385,669 | A | 5/1983 | Knutsen | |
| 4,485,879 | A | 12/1984 | Kamp et al. | |
| 4,492,276 | A | 1/1985 | Kamp | |
| 4,561,508 | A | 12/1985 | Garrett | |
| 4,577,701 | A | 3/1986 | Dellinger et al. | |
| 4,583,604 | A | 4/1986 | Greer | |
| 4,646,856 | A * | 3/1987 | Dismukes | E21B 4/02 175/107 |
| 4,775,017 | A * | 10/1988 | Forrest | E21B 4/02 175/103 |
| 4,862,974 | A | 9/1989 | Warren et al. | |
| 4,941,951 | A * | 7/1990 | Sheppard | E21B 21/08 175/48 |
| 4,958,692 | A | 9/1990 | Anderson | |
| 5,184,687 | A | 2/1993 | Abdrakhmanov et al. | |
| 5,474,143 | A | 12/1995 | Majkovic | |
| 5,522,467 | A | 6/1996 | Stevens et al. | |
| 5,722,496 | A | 3/1998 | Connell et al. | |
| 5,810,100 | A | 9/1998 | Samford | |
| 5,819,862 | A | 10/1998 | Matthias et al. | |
| 6,209,667 | B1 | 4/2001 | Murray et al. | |
| 6,213,229 | B1 | 4/2001 | Majkovic | |
| 6,234,261 | B1 | 5/2001 | Evans et al. | |
| 6,640,910 | B2 | 11/2003 | Grupping | |
| 7,139,689 | B2 | 11/2006 | Huang | |
| 7,299,886 | B2 | 11/2007 | Wenzel | |
| 7,562,725 | B1 | 7/2009 | Broussard et al. | |
| 8,201,642 | B2 * | 6/2012 | Radford | E21B 7/002 175/107 |
| 8,276,689 | B2 | 10/2012 | Giroux et al. | |
| 9,157,281 | B2 | 10/2015 | Harvey et al. | |
| 2004/0003946 | A1 | 1/2004 | Yong et al. | |
| 2005/0039953 | A1 * | 2/2005 | Crooks | E21B 10/28 175/325.3 |
| 2006/0237234 | A1 | 10/2006 | Dennis et al. | |
| 2008/0066958 | A1 | 3/2008 | Haci et al. | |
| 2010/0096189 | A1 * | 4/2010 | Salzer, III | E21B 17/1078 175/92 |
| 2012/0145460 | A1 | 6/2012 | Salzer, III et al. | |
| 2012/0279784 | A1 * | 11/2012 | Harvey | E21B 10/086 175/265 |
| 2016/0053548 | A1 | 2/2016 | Harvey et al. | |
| 2016/0138341 | A1 * | 5/2016 | Berube | E21B 7/28 175/107 |

FOREIGN PATENT DOCUMENTS

| | | | |
|---|---|---|---|
| GB | 2 349 658 | A | 11/2000 |
| GB | 2462306 | A | 2/2010 |
| GB | 2468781 | A | 9/2010 |
| SU | 1270282 | A1 | 11/1986 |
| WO | 2004/042184 | | 5/2004 |
| WO | 2010127450 | A1 | 11/2010 |
| WO | 2012/021069 | A1 | 2/2012 |

OTHER PUBLICATIONS

Extended European Search Report dated Nov. 12, 2014, for corresponding EP Application No. 10771943.7-1605, 6 pages.
Written Opinion dated Jul. 20, 2010, for corresponding International Application No. PCT/CA2010/000697, 3 pages.
"Near Bit Reamer (NBR®) Tool", Halliburton, Drill Bits & Services, H03018 Sep. 2009, www.halliburton.com, 2 pages.
Notification of Transmittal of the International Search Report and Written Opinion for PCT/CA2014/050192, dated May 16, 2014, 6 pages.
Extended European Search Report, dated Oct. 11, 2016, for European Application No. 14761081.0-1610 / 2964870, 8 pages.
International Search Report, dated Jul. 20, 2010, for International Application No. PCT/CA2010/00697, 5 pages.
European Office Action, dated Nov. 13, 2018, for European Application No. 14 761 081.0-1002, 6 pages.

* cited by examiner

DOWNHOLE MOTOR

FIELD

The present invention relates in general to reamers and stabilizers for use in the drilling of boreholes, and in particular to reamers and stabilizers used in conjunction with downhole motors.

BACKGROUND

Rotary reamers are used while drilling to enlarge the diameter of a borehole. When rotating, the reamers may have axes perpendicular or parallel to the tubular.

PCT application no. PCT/CA2010/000697 discloses a downhole tool for selectively reaming a wellbore or stabilizing drill string components within a wellbore which includes an elongate tool body adapted to receive reamer cartridges or stabilizer cartridges. The cartridges have a reamer insert with an array of cutting elements. The reamer insert rotates about a rotational axis transverse to the longitudinal axis of the tool.

The Halliburton Corporation also manufactures a near bit reamer tool that may be used behind the drill bit or further up the bottomhole assembly (BHA) in rotary steerable systems. Backreaming cutters mounted on pistons allow rotation out of the hole if the BHA gets stuck. The reamer is provided on a separate sub that may be inserted in the drill string.

It is useful for a reamer to be close to the bottom of the string to reduce flex and drift. In the cited cases, the downhole tool is a separate tool that is attached along the drill string. The upper and lower ends of the tools are adapted to other drill string components.

SUMMARY

The present invention provides a downhole mud motor adapted to also serve as a reaming tool.

In an embodiment there is provided a downhole mud motor is formed of plural housings containing at least a drive section and a transmission section. At least a housing of the plural housings has a longitudinal axis and incorporates a reaming section with one or more rotary reamers. Each of the one or more rotary reamers is mounted in a respective pocket for rotation about a transverse axis relative to the longitudinal axis of the at least a housing.

BRIEF DESCRIPTION OF THE DRAWINGS

Embodiments of the invention will now be described with reference to the accompanying figures, in which numerical references denote like parts, and in which.

DETAILED DESCRIPTION

Figure 1:
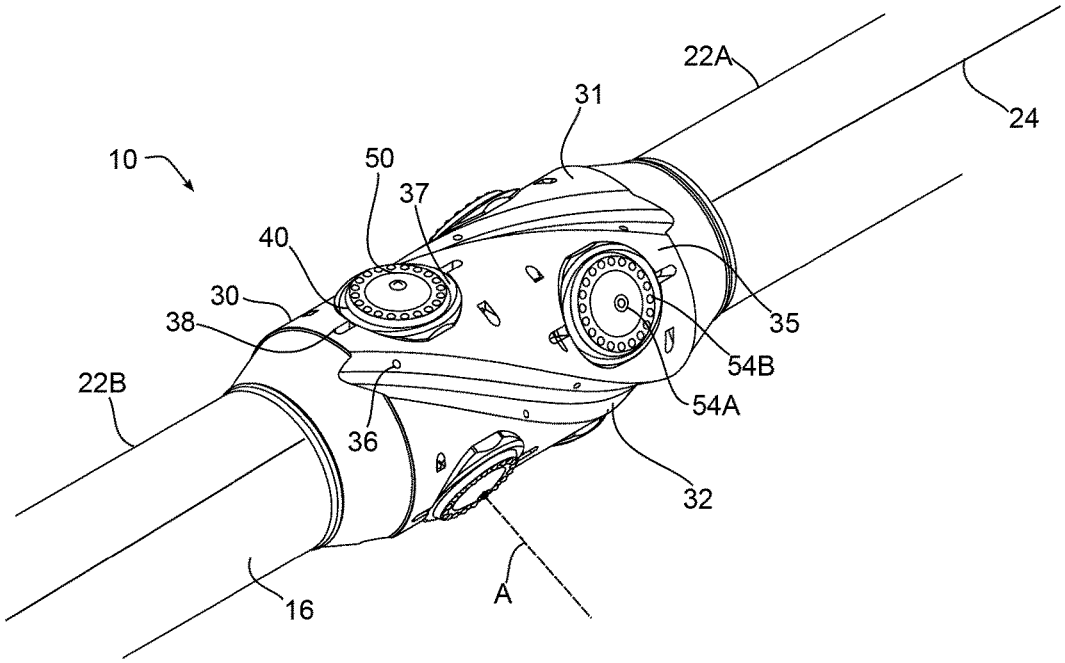
FIG. 1 is a perspective view of a mud motor with a reaming tool in accordance with a first embodiment of the present invention, shown fitted with reamer cartridges.

FIG. 1 illustrates a mud motor 10 with a housing 16 incorporating a reaming section 30 in accordance with one embodiment of the present invention. A mud motor comprises a top sub, which connects the mud motor to the drill string; a power or drive section, which incorporates a rotor and stator; a transmission section, which transmits eccentric power from the rotor as concentric power to the bit using a pair of universal joints; a bearing assembly which protects the tool from off bottom and on bottom pressures; and a bottom sub which connects the mud motor to the bit. In FIG. 1, the motor housing 16 may be any of the housings of a mud motor. The housing 16 has a longitudinal axis 24, an upper end 22 A, and a lower end 22B. In the illustrated embodiment, the housing 16 is shown as being of a generally cylindrical configuration, but this is not essential. Persons skilled in the art will readily appreciate that housing 16 could be of other geometric configurations (such as, by way of non-limiting example, a tool body having a square or other polygonal cross-section).

Upper and lower ends 22A and 22B of housing 16 are adapted for connection to other drill string components (for example taper-threaded "pin" and "box" connections, as commonly used in drilling oil and gas wells). In the illustrated embodiment, housing 16 has an enlarged central reaming section 30 with an outer surface 31. In the illustrated embodiment, reaming section 30 is of generally cylindrical configuration, with a diameter greater than the outer diameter of mud motor 10 at its upper and lower ends 22A and 22B. In alternative embodiments, however, housing 16 may have a substantially uniform cross-section (of circular or other configuration) along its length, rather than having sections of reduced size at one or both ends.

A plurality of channels 32 are formed into the outer surface 31 of reaming section 30, to allow upward flow of drilling fluid and wellbore cuttings. In the illustrated embodiments, channels 32 are diagonally or helically-oriented relative to longitudinal axis 24 of housing 16. However, this is not essential, and in alternative embodiments channels 32 could be of a different orientation (for example, parallel to longitudinal axis A-I). Channels 32 may extend partially into regions of housing 16 beyond central section 30, as illustrated in FIG. 1, but this is not essential. Channels 32 effectively divide reaming section 30 of housing 16 into a corresponding plurality of blade sections ("blades") 35. In the embodiment shown in FIG. 1, housing 16 has three channels 32 and three blades 35; however, alternative embodiments may have different numbers of channels 32 and blades 35.

Formed into outer surface 31 of each blade 35 are rotary reamers that comprise reamer inserts 50 located in cartridge pockets 37. Each cartridge pocket 37 is configured to receive a tool cartridge incorporating a cartridge bushing 40. In the embodiment shown in FIG. 1, each blade 35 has two cartridge pockets 37, but this is by way of non-limiting example only. In alternative embodiments, each blade could be provided with only a single cartridge pocket 37, particularly for situations in which the mud motor 10 will be used in a rotating drill string (as opposed to operations in which the drill string is not rotated).

Cartridge bushing 40 is configured to receive a reamer insert 50 such that reamer insert 50 is rotatable relative to cartridge bushing 40 about a rotational axis A which is substantially perpendicularly transverse to longitudinal axis 24 of housing 16, and may or may not intersect longitudinal axis 24. Rotational axis A of each tool insert is transverse to longitudinal axis 24 of housing 16, but this is not to be understood as requiring precise perpendicularity. In some embodiments, rotational axis A will be precisely perpendicular to longitudinal axis 24, but this is not essential. In alternative embodiments, rotational axis A may be tilted from perpendicular relative to longitudinal axis 24, which configuration may be beneficial in inducing rotation of the tool inserts during operations in which the drill string is being rotated.

Figure 2:
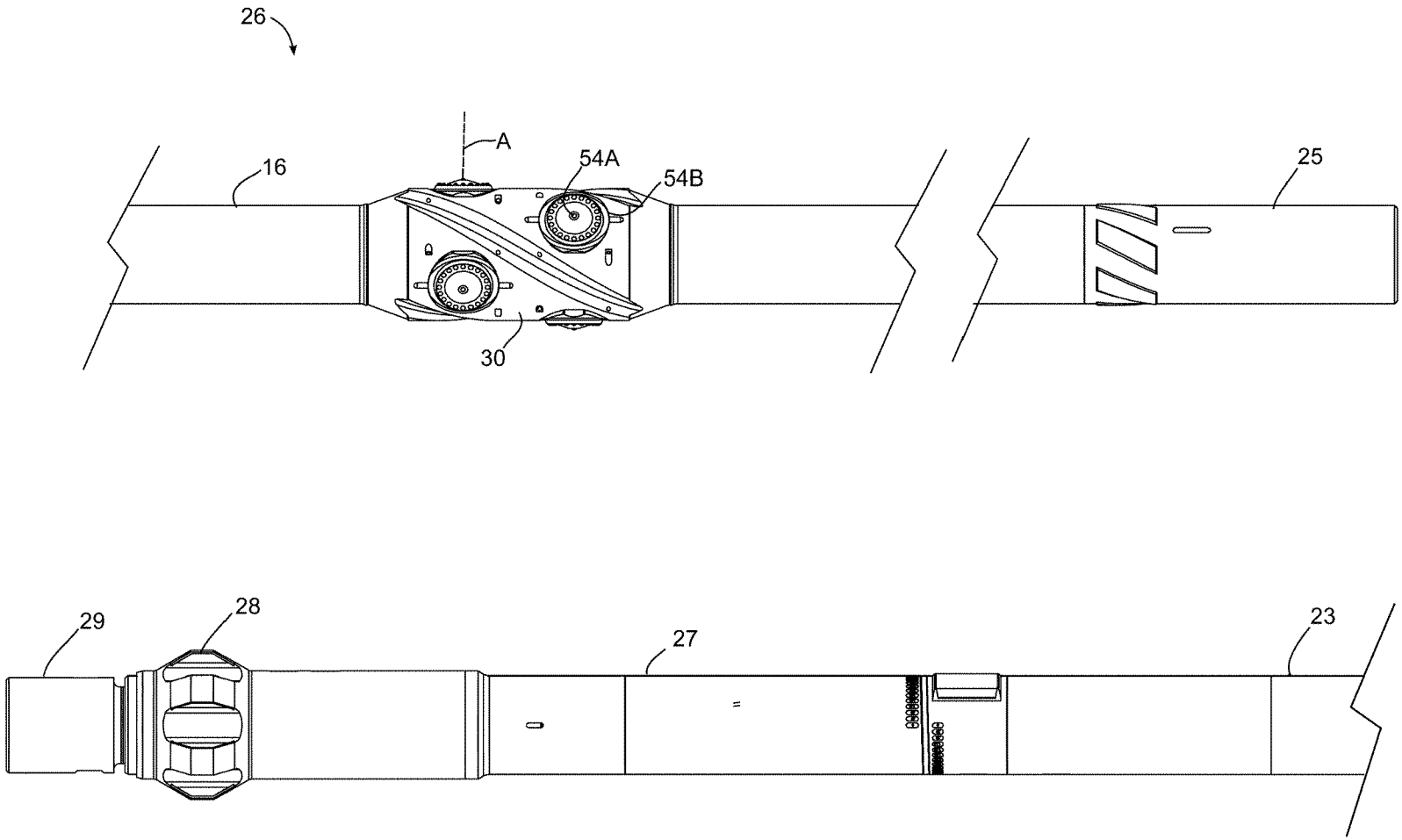
FIG. 2 is a side view of a mud motor incorporating a reaming tool as shown in FIG. 1.
Figure 3:
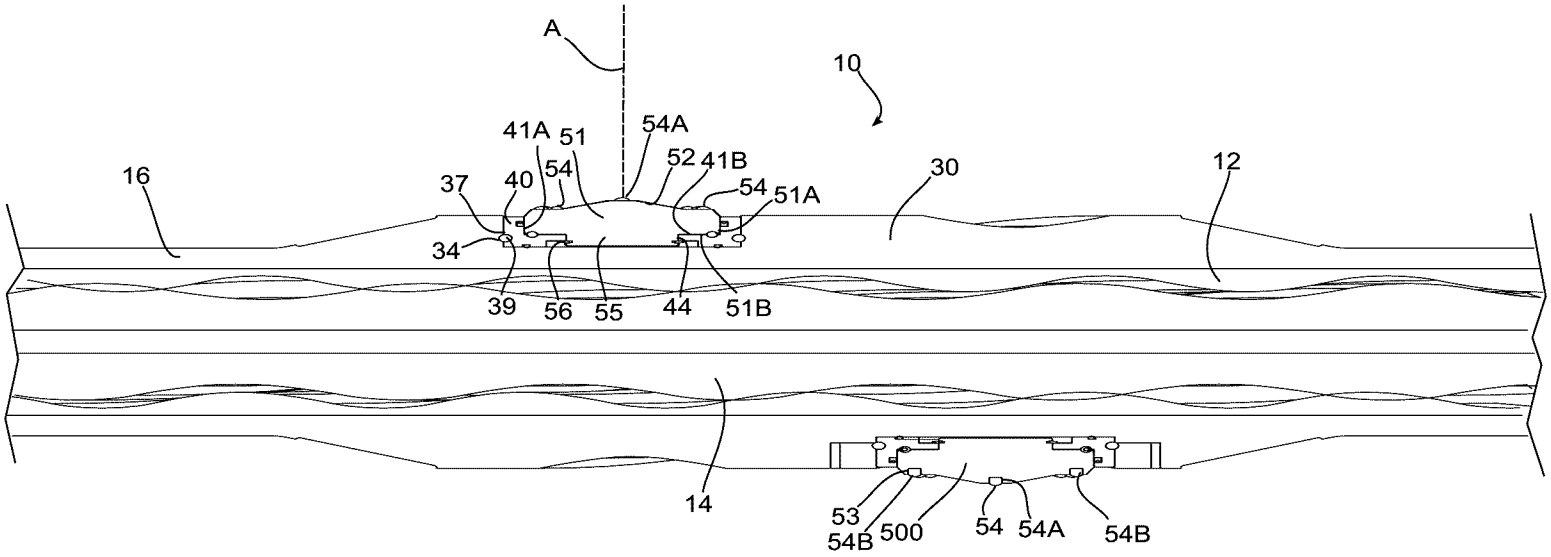
FIG. 3 is an enlarged cross-section of a drive section of a mud motor, viewed at right angles to the longitudinal axis of the tool.

FIGS. 2 and 3 illustrate a configuration of a motor 26 incorporating an adjustable bent housing 27 in which the reaming section 30 is formed as part of the stator 12 of the drive section of the motor 26. The motor 26 in FIGS. 2 and 3 includes a top sub 25, drive section illustrated by the stator 12, transmission section 23 (the upper portion of which is not shown), bent sub 27 and a bearing assembly that includes stabilizer 28 formed on a piston housing and bearing mandrel and bit box 29 that connects to a drill bit.

FIG. 3 is an enlarged cross-sectional view through the drive section of mud motor 26 comprising a rotor 14, a stator 12, housing 16A and an enlarged reaming section 30 containing reamer insert 50. The insert 50 is rotatably disposed within cartridge bushing 40. The enlarged housing is an area of increased diameter of the housing 16A that allows sufficient space for a cartridge pocket to be formed in the housing and receive a cartridge bushing. The assembly of reamer insert 50 and cartridge bushing 40 may be referred to as a reamer cartridge. Reamer insert 50 has a main body 51 with a generally domed upper surface 52, into which are formed a plurality of cutter sockets 53 for receiving cutting elements 54, which project above upper surface 52 as shown. Cutting elements 54 will preferably be made from a tungsten-carbide steel alloy, as is common for cutting elements in prior art reaming tools as well as cutting tools in other fields of industry. In the illustrated embodiment, cutting elements 54 have a domed profile, but this is by way of example only; cutting elements 54 could have different profiles to suit particular field conditions.

Persons skilled in the art will appreciate that the present invention is not limited or restricted to the use of any particular style of cutting element or any particular cutting element materials. Moreover, the present invention is not limited or restricted to the use of cutting elements disposed within cutter pockets as shown in the exemplary embodiment of FIGS. 2 and 3, as the particular means by which cutting elements are attached, anchored, bonded, or otherwise integrated with main body 51 of reamer insert 50 is entirely secondary or peripheral to the present invention.

In the embodiment shown in FIGS. 1 and 2, reamer insert 50 has a central cutting element 54A coincident with rotational axis A, plus a plurality of outer cutting elements 54B arrayed in a circular pattern around central cutting element 54A. Preferably, the outer edges of cutting elements 54A and 54B will lie at approximately the same radial distance from longitudinal axis 24 when reamer cartridge 50 is mounted in reaming section 30, with said radial distance corresponding to the desired borehole diameter (or "gauge"). If there is present an offset of rotational axis A relative to longitudinal axis 24, at least one of the outer cutting elements 54B on one side of rotational axis A (i.e., viewing mud motor 10 cross-section, as in FIG. 3) will contact the wall of a wellbore before the outer cutting elements 54B on the other side of rotational axis A. This unbalanced or eccentric contact between outer cutting elements 54B and the wellbore wall will induce rotation of reamer insert 50 when mud motor 10 is moved axially and non-rotatingly within the wellbore (such as during slide drilling or tripping operations). In preferred embodiments in which two or more reamer inserts 50 are provided in each blade 35 of mud motor 10, the effective cutting widths of the reamer inserts 50 (as defined by the layout of outer cutting elements 54B) will overlap to provide effective reaming around the full perimeter of the wellbore wall even during non-rotating axial movement of mud motor 10.

Reamer insert 50 is mounted in cartridge bushing 40 so as to be freely rotatable within cartridge bushing 40, about rotational axis A. Persons skilled in the art will appreciate that this functionality can be provided in a variety of ways using known technologies, and the present invention is not limited to any particular way of mounting reamer insert 50 in or to cartridge bushing 40. In the non-limiting exemplary embodiment shown in FIG. 3, main body 51 of reamer insert 50 has a cylindrical outer side surface 51A; a generally planar lower surface 51B bounded by cylindrical outer side surface 51A; and a cylindrical hub 55 coaxial with rotational axis A and projecting below lower surface 51B.

Cartridge bushing 40 is formed with a cylindrical cavity defined by a perimeter wall with an inner cylindrical surface 41A having a diameter slightly larger than the diameter of cylindrical side surface 51A (so as to allow free rotation of reamer insert 50 within cartridge bushing 40, preferably with minimal tolerance); with a circular opening 44 having a centroidal axis coincident with rotational axis A, with circular opening 44 being sized to receive cylindrical hub 55 of reamer insert 50. Reamer insert 50 is positioned within cartridge bushing 40 with cylindrical hub 55 disposed within circular opening.

Reamer insert 50 is rotatably retained within bushing 40 by means of a snap ring 56 disposed within a corresponding groove in the perimeter surface of cylindrical hub 55 as shown in FIG. 3. Suitable bearings are provided in suitable bearing races to transfer radially-acting reaming forces from reamer insert 50 to cartridge bushing 40. Persons skilled in the art will appreciate that there are various other ways of rotatably securing reamer insert 50 within cartridge bearing 40, and the present invention is not restricted to the use of the particular components described and illustrated herein for achieving this functionality.

Reamer cartridges 500 are removably retained within corresponding cartridge pockets 37 in mud motor 10. Persons skilled in the art will appreciate that this can be accomplished in a number of ways, and the present invention is not limited to any particular method or means of removably retaining reamer cartridges 500 within their respective cartridge pockets 37. However, in the preferred embodiment shown in FIG. 3, this is accomplished by configuring cartridge bushing 40 with two opposing and generally straight end walls, into each of which is formed an elongate groove of generally semi-circular cross-section. Each cartridge pocket 37 has corresponding opposing end walls with corresponding semi-circular grooves 34 as shown in dotted outline in FIG. 3. When cartridge bushings 40 are positioned within corresponding cartridge pockets 37, each groove of each cartridge bushing 40 will be aligned with a corresponding groove 34 in a corresponding cartridge pocket end wall, so as to define a cylindrical channel formed partly in a bushing end wall and partly in a cartridge pocket end wall, as seen in FIG. 3. A spring pin 39 (or other suitable type of fastening pin) can be inserted through a spring pin bore (not shown) to intercept the cylindrical channel in the corresponding cartridge bushing 40 and cartridge pocket end wall, as conceptually illustrated in FIG. 3. With spring pins 39 thus in place, reamer cartridges 500 are securely retained in their corresponding cartridge pockets 37.

This particular method of assembly facilitates quick and simple cartridge change-out in the shop or in the field, without need for special tools. To remove a cartridge from mud motor 10, the corresponding spring pins 39 may be simply driven out of their spring pin bores using a hammer and a suitable metal rod having a smaller diameter than the spring pin bore 36. The cartridge can then be easily pried out of its cartridge pocket 37, preferably with the aid of longitudinally-oriented pry grooves formed into blade 35 at each end of each cartridge pocket 37.

Figure 4:
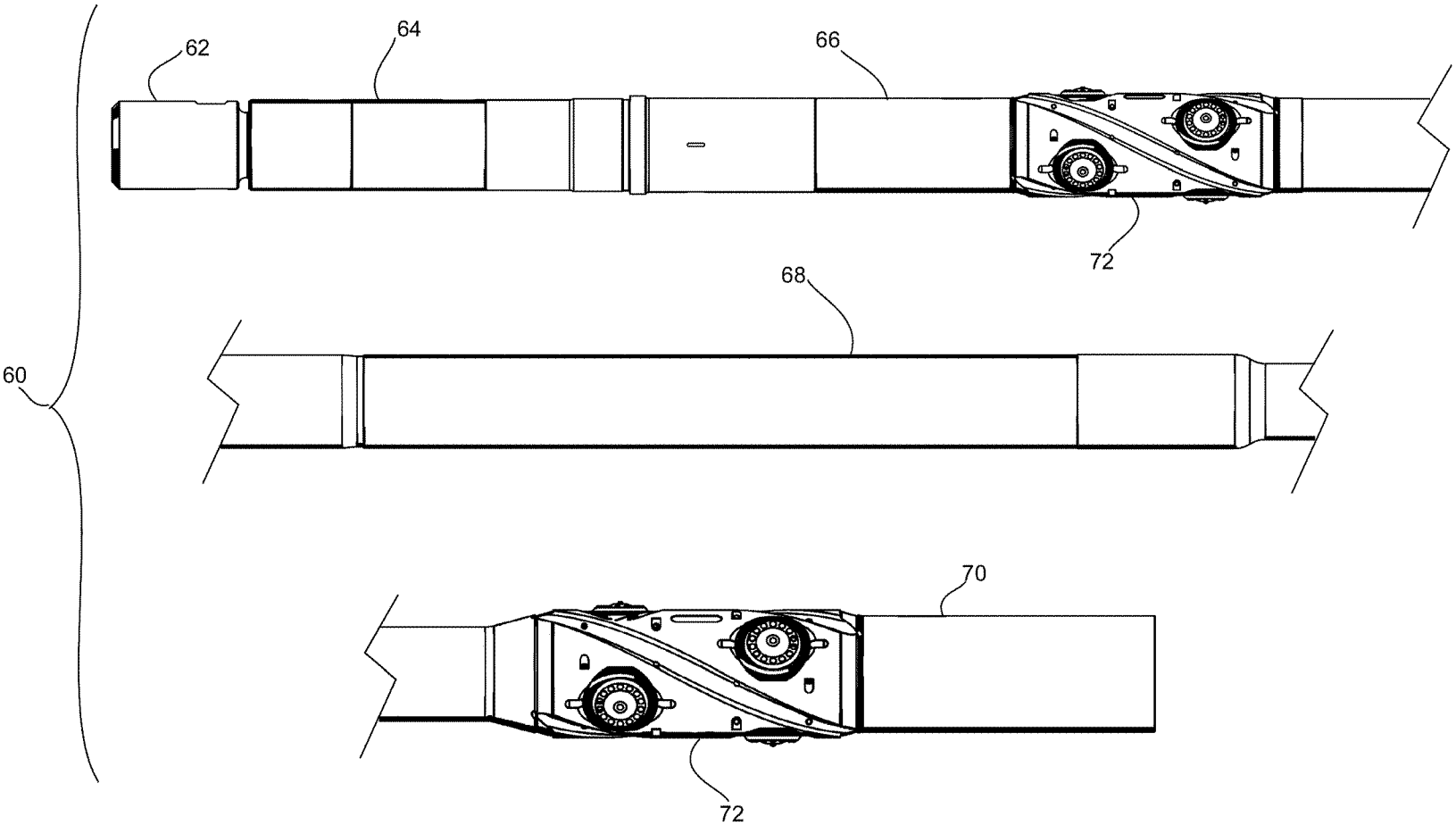
FIG. 4 is a side view of a mud motor with a straight housing and reaming tools located in the housings of the top sub and transmission section.

Referring to FIG. 4, motor 60 comprises a bit box 62, bearing assembly 64 shown without optional stabilizer, transmission section 66, drive section 68 and top sub 70. A reaming section 72 is provided within the housing of the transmission section 66 and a reaming section 74 is provided within the housing of top sub 70. The reaming sections 72 and 74 may be constructed in the same manner as the reaming section 30 shown in FIGS. 1, 2 and 3.

Figure 5:
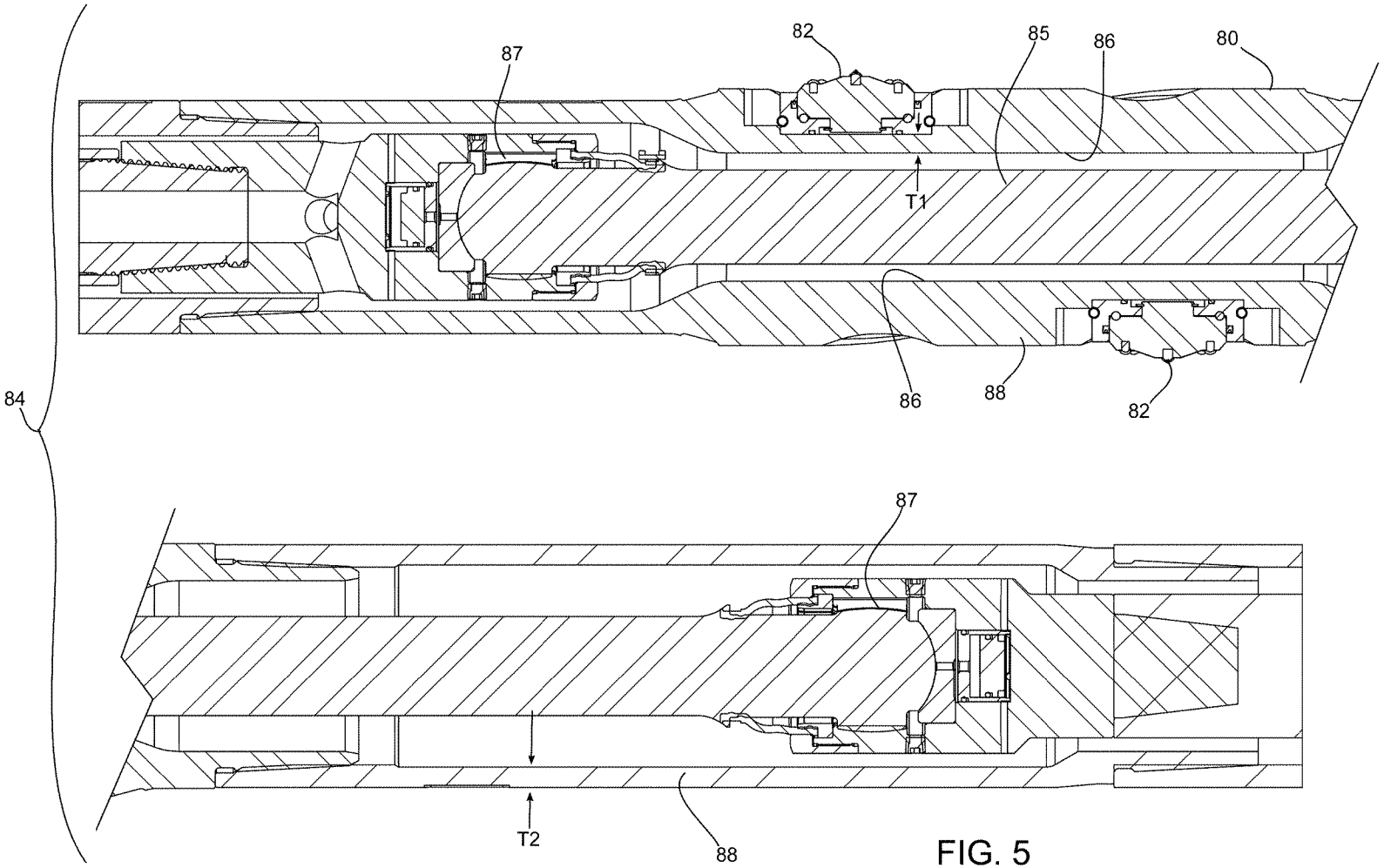
FIG. 5 is a cross-section through a transmission section of a downhole motor that incorporates a reaming section.

As shown in FIG. 2, the reaming section 30 may have an enlarged external diameter when compared with the remainder of the motor housing, but will usually not be any greater diameter than the tool joints on the drill string in which the motor is incorporated. Having an enlarged external diameter for the reaming section 30 without a reduced internal diameter of the reaming section 30 facilitates provision of the reaming section 30 in the drive section of the motor housing, where enough internal space needs to be preserved for the stator and rotor. As shown in FIG. 5, a reaming section 80 with transverse rotary reamers 82 is provided on a transmission section 84 incorporating a drive shaft 85 of a downhole motor, the drive shaft 85 being supported by U-joints 87. The reaming section 80 may have a reduced diameter 86 as well as an enlarged diameter 88 when compared with the internal and external diameters of the remainder of the transmission section 84. This is permissible since the drive shaft 85 of the transmission section 84 requires less internal space than the stator and rotor of the drive shaft. When a reaming section is incorporated in a top sub, the reaming section may be constructed in the manner of either reaming section 30 or reaming section 80. The difference between the outer and inner diameters of the reaming sections in either instance (reaming section 30 or 80) needs to be sufficient to permit the construction of the rotary reamers, without unduly weakening the housing. Enough material needs to be left at the base of the rotary reamers (bottom of the pockets) to support the rotary reamers during reaming. Although this thickness T1 need not be as high as the thickness T2 of the housing itself for example in the adapter housing 88, in most cases the thickness T1 of the base of the pockets will be close to the housing thickness T2 away from the tool joints.

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

What is claimed is:

1. A downhole mud motor, comprising:

plural housings, each housing containing one of a drive section having a stator, a bearing section having a piston housing, a bent sub, and a transmission section incorporating a drive shaft;

at least a housing of the plural housings having a longitudinal axis and incorporating one or more rotary reamers; and each of the one or more rotary reamers being mounted in a respective pocket for rotation about a transverse axis relative to the longitudinal axis of the at least a housing;

in which:

in the case of one or more rotary reamers being located in the drive section, the one or more rotary reamers are incorporated in the stator, in the case of one or more rotary reamers being located in the bearing section, the one or more rotary reamers are incorporated in the piston housing, in the case of one or more rotary reamers being located in the bent sub, the one or more rotary reamers are incorporated in the bent sub, and in the case of the one or more rotary reamers being located in the transmission section, the one or more rotary reamers are incorporated adjacent the drive shaft.

2. The downhole mud motor of claim 1 in which the at least a housing has helical channels defining blades and the one or more rotary reamers are mounted on respective blades.

3. The downhole mud motor of claim 2 in which each pocket is configured to receive a respective reaming cartridge.

4. The downhole mud motor of claim 3 in which the rotary reamers overlap each other circumferentially to provide full reaming coverage around the at least a housing.

5. The downhole mud motor of claim 1 in which the one or more rotary reamers are formed in an enlarged diameter portion of the at least a housing.

6. The downhole mud motor of claim 1 in which the at least a housing incorporates the drive section.

7. The downhole mud motor of claim 1 in which the at least a housing incorporates the transmission section.

8. The downhole mud motor of claim 1 in which the at least a housing of the plural housings incorporates the bearing section.

* * * * *